US005826302A

United States Patent [19]

Lautenschläger

[11] Patent Number: 5,826,302

[45] Date of Patent: Oct. 27, 1998

[54] ROLLER-HOLDING FITTING FOR HOLDING THE ROLLER OF A ROLLER PULL-OUT GUIDE AT A DRAWER

[75] Inventor: Horst Lautenschläger, Reinheim, Germany

[73] Assignee: MEPLA-Werke Lautenschläger GmbH & Co.KG, Germany

[21] Appl. No.: 868,754

[22] Filed: Jun. 4, 1997

[51] Int. Cl.[6] ..... A47H 15/00

[52] U.S. Cl. ..... 16/97; 16/91; 312/330.1; 312/334.14

[58] Field of Search ..... 16/97, 90, 91, 16/106, 107, 111, 94 R; 49/425; 312/330.1, 334.8, 334.9, 334.14–334.21

[56] References Cited

U.S. PATENT DOCUMENTS

| | | | |
|---|---|---|---|
| 1,866,853 | 7/1932 | Kennedy | 312/334.14 |
| 3,482,888 | 12/1969 | Anderson | 312/334.14 |
| 4,786,123 | 11/1988 | Rock et al. | 312/334.21 |
| 4,804,239 | 2/1989 | Rock et al. | 312/330.1 |
| 4,805,262 | 2/1989 | Marshik | 16/91 |
| 5,213,403 | 5/1993 | Lautenschlager | 312/330.1 |

*Primary Examiner*—Chuck Mah
*Attorney, Agent, or Firm*—Londa and Traub LLP

[57] ABSTRACT

A fitting for holding rollers of roller pull-out guides, for the rear wall of drawers, below the bottom and next to a side wall of the drawer, and protruding beyond the underside of the bottom. The longitudinal edges of the bottom of the drawer are held in grooves in the respectively assigned side walls of the drawer. The roller is rotatably mounted on a bearing flange section of the holding fitting, which can be mounted on the drawer. The bearing flange section protrudes downwards at right angles from a panel-shaped supporting flange section that can be fastened in horizontal abutment to the underside of the bottom of the drawer at a distance from and parallel to the side wall of the drawer. At least one matching flange section is provided at a distance from the bearing flange section and essentially parallel to the supporting flange section. The matching flange protrudes at right angles downwards in the same direction as the bearing flange section and can be placed against the inner surface of the side wall of the drawer. At least one tab-like shoulder protrudes from the supporting flange section downward beyond the matching flange section, and points towards the associated side wall of the drawer.

14 Claims, 1 Drawing Sheet

ROLLER-HOLDING FITTING FOR HOLDING THE ROLLER OF A ROLLER PULL-OUT GUIDE AT A DRAWER

The invention relates to a fitting for holding the drawer-side roller of a roller pull-out guide within the carcass below the bottom of the drawer and next to a side wall of the drawer protruding beyond the underside of the bottom, for which drawer the longitudinal edges of the bottom of the drawer are held in grooves in the respectively assigned side walls of the drawer.

BACKGROUND

For conventional roller pull-out guides, the rollers were disposed in each case on the outside of the carcass at the front end of the guide rail to be installed on the side wall of the carcass and on the end of the running rail mounted on the inside of the carcass to be installed at the drawer, in that they are mounted rotatably on a bearing axis protruding from the cross-member surface of the respective rail. Under certain conditions, such a rotatable mounting of the rollers on the rails themselves and, moreover, particularly of the rollers, which are disposed on the end of the running rail within the carcass and roll on the guide rail, represents a problem. Particularly when the thickness of the sheet metal, selected for the running rail, is very slight, a sufficiently loadable holding of the bearing axis at the running rail can become critical. This is the case particularly when the roller is disposed behind the rear wall of the roller, as is frequently desirable in order to be able to pull the rear wall of the drawer out up to the open front side of the carcass of the cabinet, cupboard or wardrobe, so that the drawer then is completely free for access by the user. It has therefore already been proposed to provide the rollers, which are provided at the end of the drawers within the carcass, at separate holding fittings, which are to be fastened to the drawer and at which a sufficiently firm connection of the bearing axis of the rollers is possible. The running rails themselves can then be produced from relatively thin-walled sheet metal material, because they can be supported and fastened in the region, which does not protrude beyond the rear wall of the drawer, over the whole of their length at the underside of the bottom of the drawer and additionally also at the in each case adjacent side wall.

It is the object of the invention to provide a holding fitting for rollers of roller pull-out guides assigned to drawers, which inventive holding fitting is to be able to withstand high loads not only with respect to the holding of the bearing axis of the rollers at the holding fitting itself, but also with respect to the fastening of the holding fitting at the drawer. At the same time, it shall be ensured, over the whole of the lifetime of the piece of furniture, that the holding fitting does not become loose and that there are no changes in the position of the roller, which is aligned on the assigned guide rail precisely with respect to the running track.

SUMMARY OF THE INVENTION

Pursuant to the invention, this object is accomplished owing to the fact that the roller is mounted rotatably at a bearing flange section of a holding fitting, which can be mounted on a drawer. The bearing flange section protrudes at right angles from a panel-shaped supporting flange section that can be fastened in horizontal abutment to the underside of the bottom of the drawer at a distance from and parallel to the side wall of the drawer. At a distance from the bearing flange section and essentially parallel to the supporting flange section, at least one matching flange section is provided, which protrudes at right angles downwards in the same direction as the bearing flange section and can be placed against the inner surface of the side wall of the drawer that protrudes downwards beyond the bottom of the drawer. From the supporting flange section, essentially aligned with this, at least one tab-like shoulder protrudes beyond the downwardly protruding matching flange section. The tab-like shoulder points towards the associated side wall of the drawer and can be inserted between the underside of the bottom of the drawer and the boundary surface, facing this underside, of the groove accommodating the bottom of the drawer. The holding fitting, which is constructed so that it can be stressed correspondingly, can thus be supported over a large area, on the one hand, at the underside of the bottom of the drawer. Additional support is achieved by the contact between the matching flange section and the side wall of the drawer. Overall, a holding device for the roller of the drawer, which can absorb particularly high loads, is then attained particularly by the position of the tab-like shoulder, and preferably of several tab-like shoulders, provided in the specified fastening position between the underside of the bottom and the facing boundary surface of the groove in the side wall of the drawer.

This is also the case when the bearing flange section protrudes over the rear boundary edge of the supporting flange section and the roller is disposed in the region of the bearing flange section protruding backwards over the supporting flange section.

At its rear end, the supporting flange section of the holding fitting advisably has a boundary edge extending parallel to the rear wall of the drawer. From this boundary edge, a tab-like shoulder, which can be brought into contact with the rear surface of the rear wall of the drawer, protrudes upwards.

This tab-like shoulder, which protrudes upwards from the rear boundary edge of the supporting flange section, then advisably has means for fastening it to the rear wall of the drawer. These means can be formed, for example, by at least one borehole, through which the shaft of a fastening screw, which can be screwed into the rear wall of the drawer, can pass. Alternatively or additionally, at least one blade-like sharpened or pointed projection, which points to the rear wall of the drawer, can be provided at the upper free edge of the tab-like free shoulder. In the specified installed position of the holding fitting, the shoulder engages the material of the rear wall of the drawer.

The arrangement of at least two blade-like sharpened or pointed projections at the upper free edge of the tab-like shoulder, which secures the mounted holding fitting against twisting in the sense of a slanting of the assigned roller, has proven to be advantageous.

As indicated previously, it may be appropriate to provide several tab-like shoulders, which protrude from the supporting flange section to the associated side wall of the drawer and which are at a distance from one another. In plan view, these shoulders advisably have a shape tapering triangularly or trapezoidally from the supporting flange section in order to facilitate the mounting of the holding fitting by pressing or driving it into the space between the underside of the bottom and the facing boundary surface of the groove. For this purpose, it may furthermore be of advantage if the boundary edges of the tab-like shoulders, averted from the supporting flange, are formed so as to taper blade-like or wedge-like in cross section.

With respect to increasing the stressability of the seat of the holding fitting mounted at a drawer, it may furthermore be of advantage if the tab-like shoulder or shoulders are tilted up at a slight angle to the horizontal relative to the supporting flange section in the direction of their boundary edge averted from the supporting flange section. When pressing the tab-like shoulders into the accommodating groove for the bottom of the drawer, a prestress, which presses the flange section under prestress against the underside of the bottom, is produced as the shoulders penetrate increasingly into the groove.

If the inventive holding fitting is to be affixed to drawers, the rear wall of which, corresponding to the side walls, protrudes downward over the underside of the bottom of the drawer, it is advantageous if the rear wall of the drawer, in its region protruding downwards over the bottom of the drawer and laterally adjoining the respectively assigned side wall of the drawer, in each case has a cutout, the height of which is at least equal to the height measured from the free lower leading edge of the rear wall up to the underside of the bottom of the drawer and the width of which is at least equal to the horizontal distance between the mutually averted, vertical surfaces of the bearing flange section and of the matching flange section.

The holding fitting preferably is produced by a stamping press method from originally flat sheet metal. The thickness of the sheet metal to be used for the holding fitting is selected to be adequate to prevent deformation of the bearing flange section by the stresses arising when the drawer is pulled out and pushed in. By impressing reinforcing corrugations and bends into the sheet metal material, the load-bearing capacity of the flange section of the holding fitting can, if necessary, be increased additionally.

The holding fitting, which is designed pursuant to the invention and carriers the roller, can be formed as a separate component, which can be mounted at the drawer independently of the running rail. Alternatively, however, it may also be advisable if the holding fitting is fastened to the running rail of the pull-out guide in such a manner, that a common installation of the running rail and the fastening rail can take place. By these means, the precisely aligned positioning of holding fitting and running rail at the drawer is then also ensured.

BRIEF DESCRIPTION OF THE DRAWINGS

The invention is explained in greater detail in the following description of an example in conjunction with the drawing, in which

In FIG. 1, the rear and—as seen from the rear wall of the cabinet, cupboard or wardrobe—left lower corner region of a drawer 10 is shown, of which the rear wall 12 is only indicated by lines of dots and dashes, while the bottom 14 and the side wall 16 of the drawer 10 are shown by solid lines. For installing a roller 18 on the drawer 10, which roller 18 rolls on a guide rail (not shown), which is to be fastened to the carcass of the cabinet, cupboard or wardrobe, the roller 18 is rotatably mounted on a downwardly canted bearing flange section 20 of a holding fitting 22 (FIG. 2), which is stamped out of sheet metal and canted and provided with additional reinforcing corrugations. The holding fitting 22 has a horizontal, extended supporting flange section 24, which can be placed against the underside of the bottom 14 of the drawer 10 and from which the bearing flange section 20 is canted downwards at right angles. From the longitudinal side of the supporting flange section 24, lying opposite the bearing flange section 20, two matching flange sections 26 and 28, offset in the longitudinal direction, are canted. In the specified fastening position (FIG. 1), the matching flange sections 26 and 28 lie against the inside of the section of the inside of the side wall 16 of the drawer 10, which section protrudes downwards over the bottom 14 of the drawer 10. In addition, pointed tab-like shoulders 30, which are spaced apart in the longitudinal direction, protrude from the edge of the supporting flange section 24. In the specified fastening position, the tab-like shoulders 30 can be pressed between the underside of the bottom 14 of the drawer 10 and the lateral boundary surface of the longitudinal groove 32 in the side wall 16 of the drawer 10 accommodating the bottom, which boundary surface faces the bottom 14 of the drawer 10. As can be seen particularly in FIG. 4, these tab-like shoulders 30 are sharpened blade-like and are bent slightly upwards relative to the horizontal course of the supporting flange section 24, so that, when pressed or driven into the groove 32, they are wedged firmly in the space between the bottom 14 and the assigned boundary wall of the groove 32 and, at the same time, press the supporting flange section 24 under pretension against the underside of the bottom 14.

Figure 1:
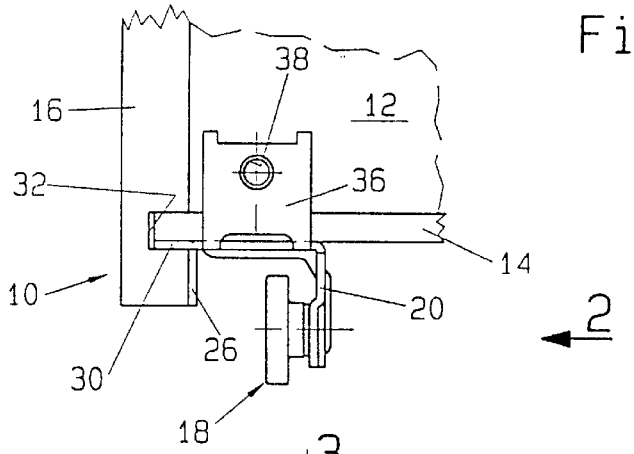
FIG. 1 shows the roller-holding fitting of this invention as seen from the rear wall, rear left corner region of a drawer.
Figure 2:
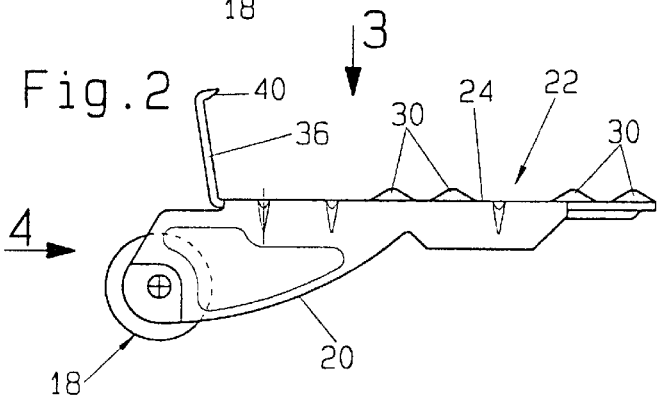
FIG. 2 shows the roller-holding fitting of FIG. 1, seen in the direction of arrow 2.

At the rear boundary edge of the supporting flange section 24, that is, pointing towards the (not shown) rear wall of the carcass of the piece of furniture accommodating the drawer 10, a tab-like shoulder 36, canted upwards, is joined with a fastening borehole 38. In the specified fastening position, the shoulder 36 is bolted to the rear wall 12 of the drawer 10. At the same time, blade-like sharpened or pointed projections 40, joined to the upper free edge, penetrate into the back side of the rear wall 12 of the drawer 10.

Figure 4:
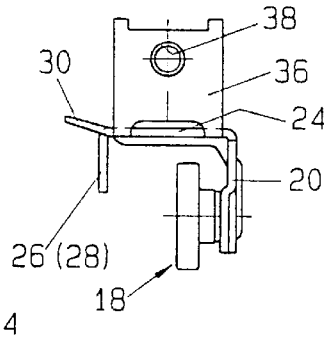
FIG. 4 shows the holding fitting of FIG. 2 as seen in the direction of arrow 4.
Figure 3:
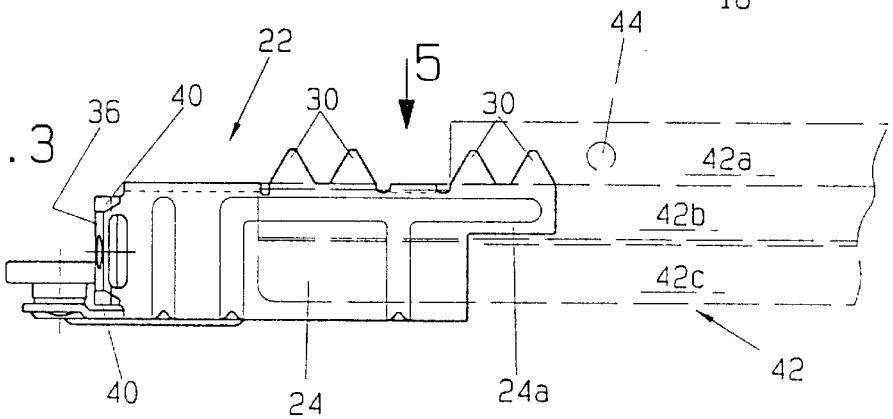
FIG. 3 shows the holding fitting of FIG. 2, seen in the direction of arrow 3.
Figure 5:
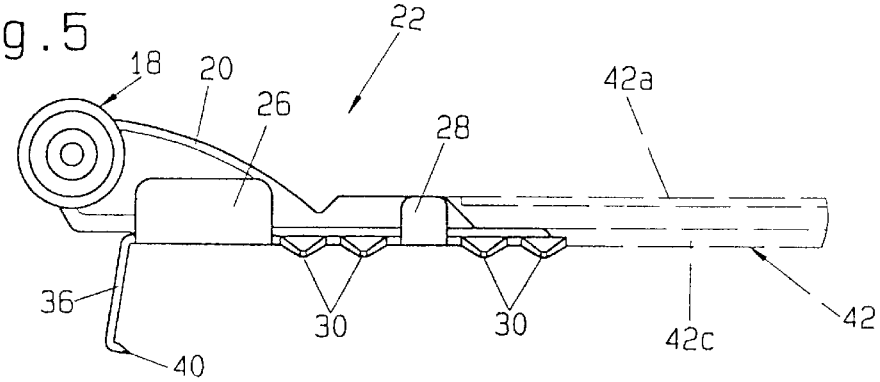
FIG. 5 shows the holding fitting of FIG. 3, seen in the direction of arrow 5.

In FIGS. 3 and 5, the running rail, which adjoins the holding fitting 22 and is to be disposed so as to extend in the direction of the front side of the drawer 10 and which is a profiled rail transformed from an originally flat strip of sheet metal, is indicated by lines of dots and dashes. This profiled rail has a strip-shaped section 42*a,* which grips below the downwardly pointing end face of the side wall of the drawer, on which, offset in height, the section 42*b,* which serves as track for the roller (not shown), provided at the guide rail of a roller pull-out guide affixed to the carcass, adjoins. In the example of the holding fitting 22 shown, the section 42*b* overlaps the tongue-like extension 24*a,* which in FIG. 4 is joined to the right boundary edge of the supporting flange section 24 and is provided with two of the total of four tab-like projections 30. A further, elongated section 42*c* is provided, which once again is offset in height and, in the specified installation position of the running rail 42 at the drawer 10, is supported at the underside of the bottom 14 of the drawer 10. Boreholes 44, provided in the strip-shaped section 42*a,* serve for fastening the running rail 42 to the drawer. The shafts of fastening screws can be screwed through these boreholes 44 into the downwardly pointing end face of the respectively adjacent side wall 16 of the drawer 10.

It is clear that the running rail 42 with the holding fitting 22 can also be combined into a component, which can be handled as a unit, in that, for example, the tongue-like elongation 24*a* is connected with the strip-shaped section 42*b,* for example, by resistance welding or by riveting.

It is important in this connection that the sheet metal material, used to produce the holding fitting 22, has a strength, which in every case withstands the stresses acting when the drawer is pulled out or pushed in over the roller 18, it being possible to increase the resistance to deformation by corrugations impressed in the flange sections 20 and 24 of the holding fitting 22.

The bearing axis of the roller 18 can, in the usual manner, be riveted in a borehole in the bearing flange section 20 or fastened non-detachably by electrical resistance welding.

What is claimed is:

1. A fitting for holding, within a carcass, a roller of a roller pull-out guide in a position below the bottom and next to a side wall of an associated drawer, the side wall of which protrudes over the underside of the bottom and where the longitudinal edges of the bottom of the drawer are held in grooves in associated side walls of the drawer, said fitting comprising:

a panel-shaped supporting flange section fastenable in horizontal abutment to the underside of the drawer bottom, a bearing flange section on which the roller is rotatably mounted, said bearing flange section protruding downward and at a right angle from the supporting flange, at least one matching flange section for placement against the inner surface of the drawer side wall that extends below the bottom of the drawer, the matching flange section protruding downward and at a right angle from the supporting flange section in the same direction as the bearing flange section, said matching flange section being spaced apart from and parallel to the bearing flange section, and at least one tab-like shoulder for insertion into an associated groove in the associated drawer side wall which accommodates the bottom of the drawer, said shoulder extending from and in alignment with the supporting flange section in a direction towards the associated drawer side wall.

2. The fitting according to claim 1, wherein the bearing flange section protrudes beyond a rear boundary edge of the supporting flange, section and the roller is disposed in the region of the bearing flange section protruding rearwards beyond the supporting flange section.

3. The fitting according to claim 1, wherein the supporting flange section has, at a rear end, a boundary edge running parallel to the rear wall of the drawer and a tab-like shoulder, for contacting the rear surface of the rear wall of the drawer, protrudes upwards from the boundary edge.

4. The fitting according to claim 3, wherein the tab-like shoulder, further comprises means for attachment to the rear wall of the drawer.

5. The fitting according to claim 4, wherein the tab-like shoulder has at least one borehole for the passage of the shaft of a fastening screw for fastening the rear wall of the drawer.

6. The fitting according to claim 4, further comprising at least one blade-like sharpened or pointed projection, provided at an upper free edge of the tab-like shoulder, and extending in a direction towards the rear wall of the drawer.

7. The fitting according to claim 6, wherein at least two blade-like sharpened or pointed projections are provided at a distance spaced apart from one another in the horizontal direction at the upper free edge of the tab-like shoulder.

8. The fitting according to claim 1, wherein several tab-like shoulders, protruding from the supporting flange section towards an associated side wall of the drawer, are provided at a distance spaced apart from one another.

9. The fitting according to claim 8, wherein the tab-like shoulders, in the region protruding towards the side wall of the drawer, taper in plan view triangularly or trapezoidally from the supporting flange section.

10. The fitting according to claim 8, wherein free boundary edges of the tab-like shoulders, averted from the supporting flange section, are tapered blade-like or wedge-shaped in cross section.

11. The fitting according to claim 8, wherein the tab-like shoulders are canted upward at a slight angle to the horizontal relative to the supporting flange section in the direction of their boundary edge averted from the supporting flange section.

12. The fitting according to claim 2 for a drawer, the rear wall of which protrudes downward over the underside of the bottom of the drawer, the rear wall of the drawer, in its region protruding downwards over the bottom of the drawer and laterally adjoining the assigned side wall of the drawer, in each case has a cutout, the height of which is at least equal to the height measured from the free lower leading edge of the rear wall up to the underside of the bottom of the drawer and the width of which is at least equal to the horizontal distance measured over the mutually averted, vertical surfaces of the bearing flange section and of the matching flange section.

13. The fitting of according to claim 1, wherein the fitting is an integral component produced by a stamping press method from originally flat sheet metal.

14. The fitting according to claim 13, wherein an end of the fitting, averted from the roller, is fastenable at the rear end, within the carcass, of an associated running rail of the pull-out guide.

* * * * *